US010233636B2

(12) United States Patent
Kennedy

(10) Patent No.: US 10,233,636 B2
(45) Date of Patent: Mar. 19, 2019

(54) MODULAR INSULATED WALL SYSTEM

(71) Applicant: Mod Panel Manufacturing Ltd., Edmonton (CA)

(72) Inventor: David Kennedy, Edmonton (CA)

(73) Assignee: Mod Panel Technologies Ltd. (CA)

( * ) Notice: Subject to any disclaimer, the term of this patent is extended or adjusted under 35 U.S.C. 154(b) by 0 days.

(21) Appl. No.: 15/856,808

(22) Filed: Dec. 28, 2017

(65) Prior Publication Data

US 2018/0187414 A1 Jul. 5, 2018

Related U.S. Application Data

(60) Provisional application No. 62/441,158, filed on Dec. 30, 2016.

(51) Int. Cl.

| | |
|---|---|
| ***E04B 2/88*** | (2006.01) |
| ***E04B 2/28*** | (2006.01) |
| ***E04B 2/96*** | (2006.01) |
| ***E04B 1/76*** | (2006.01) |
| *E04B 1/68* | (2006.01) |

(52) U.S. Cl.

CPC ..... *E04B 2/88* (2013.01); *E04B 1/7629* (2013.01); *E04B 2/28* (2013.01); *E04B 2/96* (2013.01); *E04B 1/6806* (2013.01)

(58) Field of Classification Search

CPC ..... E04B 2/88; E04B 2/96; E04B 2/28

See application file for complete search history.

(56) References Cited

U.S. PATENT DOCUMENTS

| | | | | |
|---|---|---|---|---|
| 2,023,452 | A * | 12/1935 | Voegeli | E04C 2/292 52/378 |
| 2,221,001 | A * | 11/1940 | Lucius | E04B 9/02 165/57 |
| 2,762,470 | A * | 9/1956 | Parkes | E04C 2/292 52/404.4 |
| 3,045,293 | A * | 7/1962 | Potchen | E04B 2/58 105/424 |
| 3,420,396 | A * | 1/1969 | Bridges | F17C 3/025 220/560.04 |
| 4,439,960 | A * | 4/1984 | Jenkins | E04C 2/292 52/396.04 |
| 5,440,854 | A * | 8/1995 | Hohmann | E04B 1/4178 52/379 |
| 8,910,441 | B1 * | 12/2014 | Hunter | E04F 13/0805 52/474 |

(Continued)

FOREIGN PATENT DOCUMENTS

DE 3439291 A1 * 4/1986 ..... E04B 2/96

*Primary Examiner* — Jeanette E Chapman

(74) *Attorney, Agent, or Firm* — DLA Piper LLP (US)

(57) ABSTRACT

A modular insulated wall system for attaching to a wall having a plurality of insulated wall panels. Each panel has a top-side surface and a substantially parallel bottom-side surface. The top-side surface and bottom-side surface each are complementary stepped and substantially parallel in a first direction. The panels have a front surface and a substantially parallel back surface. The wall system also has a plurality of substantially parallel z-girts. The z-girts are engaged with the stepped surfaces of the plurality of panels. The wall system also has a plurality of substantially parallel support members in a second direction. The support members affixed to the z-girts and abutting the back surface of the panels.

14 Claims, 5 Drawing Sheets

(56) References Cited

U.S. PATENT DOCUMENTS

| | | | | |
|---|---|---|---|---|
| 9,243,399 | B2 * | 1/2016 | Kubassek | E04B 1/40 |
| 9,677,268 | B2 * | 6/2017 | Knight | E04B 2/562 |
| 9,732,518 | B2 * | 8/2017 | Croasdale | E04B 2/562 |
| 9,856,655 | B2 * | 1/2018 | Knight | E04F 13/0864 |
| 2004/0128930 | A1 * | 7/2004 | Ohnishi | E04B 1/78 52/474 |
| 2010/0146893 | A1 * | 6/2010 | Dickinson | E04B 1/70 52/302.3 |
| 2011/0173902 | A1 * | 7/2011 | Hohmann, Jr. | E04B 1/4178 52/167.1 |
| 2014/0026510 | A1 * | 1/2014 | Kubassek | E04B 1/40 52/512 |

* cited by examiner

MODULAR INSULATED WALL SYSTEM

REFERENCE TO PRIOR APPLICATIONS

This application claims priority from U.S. Application No. 62/441,158, filed Dec. 30, 2016, which is incorporated herein by reference.

FIELD

This disclosure relates to a wall and building insulation system and, in particular, to modular insulated wall systems to quickly assemble an exterior wall with a rainscreen aspect.

BACKGROUND

There are wall insulation systems using fibreglass batts that are placed between wall studs and spray-applied foams, such as polyurethane foams, that expand into a wall cavity after spaying application. Although these systems typically provide effective insulation, they are laborious to install during the construction phase, requiring considerable effort and time. This often translates into increased construction expense. Spray-foam insulation typically also requires skilled or trained spray operators and expensive on-site spraying equipment.

A rainscreen is an exterior wall detail where the siding (wall cladding) stands off from a moisture-resistant surface of an air barrier applied to the sheathing (sheeting) to create a capillary break and to allow drainage and evaporation. A rainscreen in a wall is sometimes defined as the first (exterior) layer of material on the wall, such as the siding itself. A rainscreen may also be defined as the entire system of the siding, drainage plane and a moisture/air and vapor barrier. In general terms a rainscreen wall may be called a cavity or drained wall. Typically the rain screen prevents the wall air/moisture barrier on sheathing from getting wet. Conventional rain screens often require multiple steps to construct, wherein each component is installed and fastened independently, requiring significant labor and time to install the final assembly.

Therefore, what is needed is a wall insulation system which can be applied quicker, with less of a labor demand, which reduces on-site installation time, which quickly and easily establishes a rainscreen cavity, and which can be installed by unskilled laborers.

SUMMARY

A modular insulated wall system for attaching to a wall having a plurality of insulated wall panels. Each panel has a top-side surface and a substantially parallel bottom-side surface. The top-side surface and bottom-side surface each are complementary stepped and substantially parallel in a first direction. The panels have a front surface and a substantially parallel back surface. The wall system also has a plurality of substantially parallel z-girts. The z-girts are engaged with the stepped surfaces of the plurality of panels. The wall system also has a plurality of substantially parallel support members in a second direction. The support members affixed to the z-girts and abutting the back surface of the panels.

BRIEF DESCRIPTION OF THE DRAWINGS

In drawings which illustrate by way of example only a preferred embodiment.

DETAILED DESCRIPTION

Figure 1:
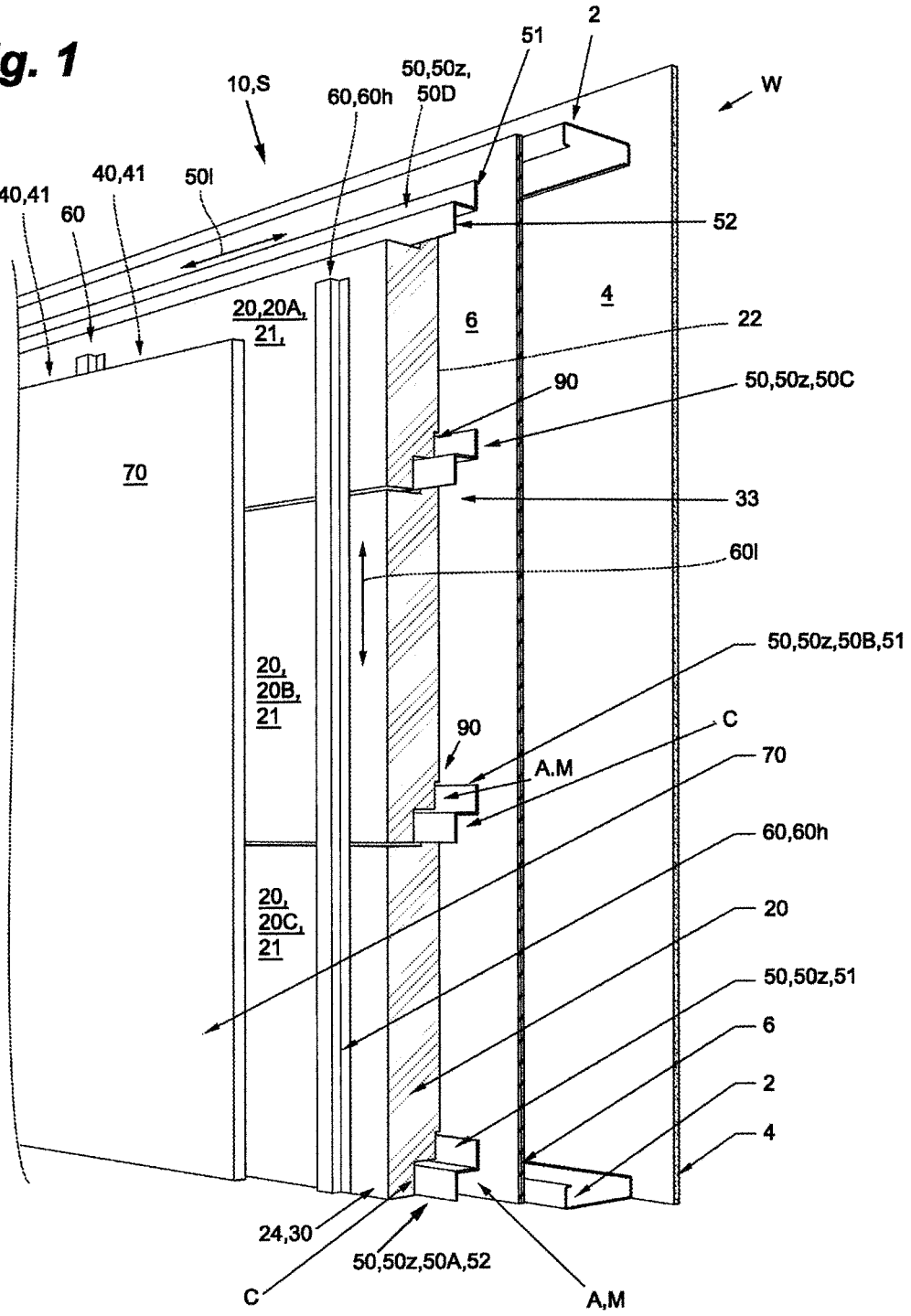
FIG. 1 is a perspective, partial cut-away view of a first embodiment of the insulated modular wall system.

The following description is of preferred embodiments by way of example only and without limitation to the combination of features necessary for carrying the disclosure into effect. Reference is to be had to the Figures in which identical reference numbers identify similar components. The drawing figures are not necessarily to scale and certain features are shown in schematic or diagrammatic form in the interest of clarity and conciseness.

With reference to FIGS. 1 to 6, an embodiment of a modular insulated wall system 10 is preferably comprised of a plurality of modular insulating panels 20 (e.g., individually identified as 20A-20C in FIG. 1), at least one first elongate support member 50 and at least one second elongate support member 60. The modular insulating panels 20 may be comprised of a foamed synthetic resin made of polystyrene, polyethylene, polyurethane, acrylic resin, phenol resin, urea resin, epoxy resin, diallylphthalate resin, urethane resin and the like. Preferably, the modular insulating panels 20 are comprised of a 2-pound, medium density, closed cell, polyurethane foam.

The plurality of modular insulating panels 20 are configured in the system 10 to form a substantially vertically oriented assembly or stack S; such as with two or more panels 20 to extend the height, or to join with each other side-by-side to extend the width of the stack S. The assembly or stack S of the plurality of modular insulating panels 20 is preferably mounted to a wall member W, which may be comprised of a plurality of wall studs 2 supporting an interior wall 4 (such as gypsum wall board) and an exterior sheathing 6 (such as oriented strand board).

The modular insulating panel 20 has a front surface 21 and an opposing back surface 22. When installed in the system 10, the panel 20 is preferably configured to be placed with the back surface 22 facing any exterior sheathing 6 of the wall member W (see FIG. 2). The panel 20 is preferably surrounded by a top side-surface 23, a bottom side-surface 24, a first edge 25, and a second edge 26. The panel 20 is preferably a planar member, substantially rectangular in shape, such that the top side-surface 23 is substantially parallel to the bottom side-surface 24 and the first edge 25 is substantially parallel to the second edge 26 and perpendicular to the top side-surface 23. In many, but not all, applications, the panels 20 are placed with their planar aspect (or plane) in a vertical position with the first and second edges 25, 26 parallel to the vertical direction. In other applications, the panels 20 may be placed in a substantially horizontal position. Panels 20 may be provided in provided in 4 ft wide×8 ft long sheets.

As indicated in FIGS. 1-6, each modular insulating panel 20 has a panel core having a panel thickness 20*t* defined by the front surface 21 and the back surface 22. As also shown in FIGS. 1-6, the edges and sides of each panel 20 (top side-surface 23, bottom side-surface 24, first edge 25, and second edge 26) are each preferably configured into a rabbet, or step-shaped configuration 30, so as to allow adjacent panels 20 to form a shiplap joint 33 wherein two opposing and complimentary rabbet edges 30 overlap each other, so as to hold the adjacent panels 20 together. In certain embodiments, only the top-side surface 23 and bottom-side surface 24 may be provided with a rabbet edge configuration 30; while the first and second edges 25, 26 may be substantially straight-cut.

Each rabbet edge configuration 30, when present, will have a first 20 thickness portion 31 and a second thickness portion 32. The first and second thickness portions 31,32 totaling the panel thickness 20*t*. Advantageously, any overlapping shiplap joint 33 arrangement between adjacent modular panels 20, along with the use of closed cell foam insulation in the panels 20, result in the system 10 having a monolithic type insulation formation from one modular panel (e.g., 20A) to the next panel (e.g., 20B); i.e. this arrangement of the panels 20 in the system 10 provides an air/vapor/water barrier between adjacent modular panel 20 and inherent in system 10, so as to efficiently insulate walls and building structures. This will reduce or eliminating the need for any additional vapor barriers; reducing installation time and costs. More advantageously, the rabbet edge configuration 30 of the top-side surface 23 and bottom-side surface 24, along with a first support member 50 that is substantially shaped in the form of a z-girt 50*z*, allows for a quick and efficient installation of the modular insulation panels 20 onto a wall member W, as further described below. First support members 50 may be constructed of metal or plastic.

Assembly of the modular insulation panels 20 onto a wall member W is preferably simplified by the use of at least one elongate first support member 50 which is, preferably, substantially shaped in the form of a z-girt 50*z*. For example, a first z-girt 50 (identified as 50A in FIG. 1) having a longitudinal axis 50*l*, is fastened to the exterior sheathing 6 substantially along the bottom edge of the wall member W wherein the longitudinal axis 50*l* is oriented substantially parallel to the bottom edge of wall member W (as shown). The z-girt 50 preferably comprises a first end 51 and a second end 52, wherein first end 51 is mounted flush against the sheathing 6 and the second end 52 is off-set outward of the sheathing 6, and wherein the second end 52 is oriented substantially below the first end 51, so that a first step-wise configuration A as shown in FIG. 1 is provided. The z-girt 50 may be fastened to the sheathing 6, such as with self-tapping screws through the first end 51. Advantageously, this step-wise configuration A of the z-girt 50 prevents or reduces the movement of water or condensation upward toward the first end 51, or upward into any shiplap joint 33 that may be formed around the z-girt 50A; since gravity will act to pull any such water or condensation toward the bottom of the second end 52.

More advantageously, such a step-wise configuration A reduces or eliminates the need for any additional vapor barriers; reducing installation time and costs. Note that alternate configurations of the z-girts 50 may be provided for in the system 10, such as: (i) wherein the second end 52 is 10 oriented substantially above the first end 51 and a different, second, step-wise configuration A is provided (see FIG. 3), or (ii) wherein the z-girts 50 are oriented with the longitudinal axis 50*l* oriented substantially vertical (instead of horizontal). After the first z-girt 50A is fastened to the exterior sheathing 6 substantially along the bottom edge of the wall member W, one or more panels 20 may then be placed on that z-girt 50A (e.g., panel 20C in FIG. 1), wherein the rabbet edge configuration 30 of the bottom-side surface 24 mates with the z-girt 50A in a complimentary step-wise mating arrangement M or manner (as shown in FIG. 1).

Figures 5, 6:
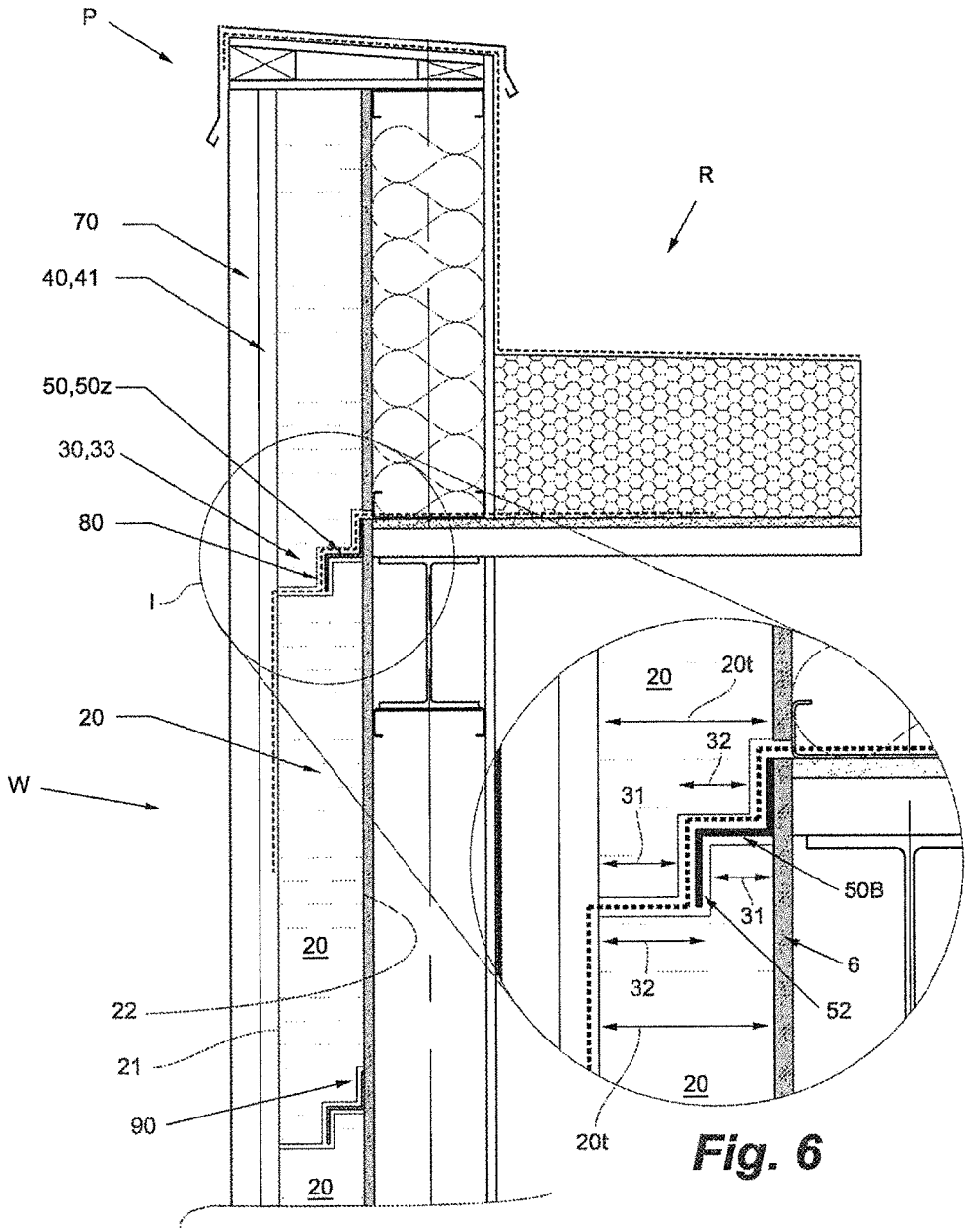
FIG. 5 is a sectioned side view of the insulated modular wall system of the embodiment of FIG. 1, showing integration of the system with a roof parapet.
FIG. 6 is an enlarged, sectioned side view of the shiplap joint shown in circle I of FIG. 5.

Another z-girt 50B may then be fastened to the exterior sheathing 6 substantially along the top-side surface 23 of the one or more panels 20 (e.g., above panel 20C in FIG. 1), so as to capture the first thickness 31 of the rabbet edge 30 of the top-side surface 23 in a step-wise capturing C arrangement, i.e. thickness 31 being captured between that z-girt's (50B) second end 52 and the sheathing 6 (see also FIG. 6). Z-girt 50B may also be fastened to sheathing 6 using its first end 51, such as with self-tapping screws through said first end 51.

Advantageously, the step-wise capturing arrangement C of this z-girt (50B) over the first thickness 31 of the top¬side surface 23, along with the step-wise configuration A, will act to divert any water or condensation along the top-side surface 23, towards the front surface 21; and away from the back surface 22 or the sheathing 6. The front surfaces 21 of the plurality of panels 20 then act as a drainage plane 40, diverting water and condensation away from the sheathing 6 and out along said plane 40, towards the bottom of the wall member W.

The z-girt (50B) that has captured the top-side surface 23 of panel 20C may also act as a support for the bottom-side surface of yet another panel (e.g., panel 20B), in the same mating arrangement M manner that z-girt 50A did for panel 20C. Such other panel (20B) may then be placed on that z-girt 50B (e.g., panel 20B in FIG. 1), wherein the rabbet edge configuration 30 of the bottom-side surface 24 mates with the z-girt 50B in the mating arrangement M. Yet a further z-girt (50C) may be provided to secure and capture the top-side surface of that panel (20B) by way of step-wise capturing arrangement C, i.e. over that panel's (20B) first thickness 31.

A plurality of modular insulating panels 20 may be fastened to a wall member W by: (i) being supported substantially along the bottom-side surface 24, such as by being mated with a z-girt 50 in a complimentary step-wise mating arrangement M; and (ii) by being substantially held along the top¬side surface 23, with the first thickness 31 being captured in a step-wise capturing arrangement C.

Advantageously, no fasteners are required to fully penetrate the modular insulating panels 20 into the sheathing 6; said panels 20 instead being mounted to the sheathing 6 by the z-girts 50*z*, and the z-girts 50*z* being mounted to the sheathing via their first ends 51. More advantageously, no thermal bridging occurs through the panels 20, and panels 20 can act in unison to provide a substantially monolithic type insulation formation between one modular panel (e.g., 20A) to the next panel (e.g., 20B).

Figure 2:
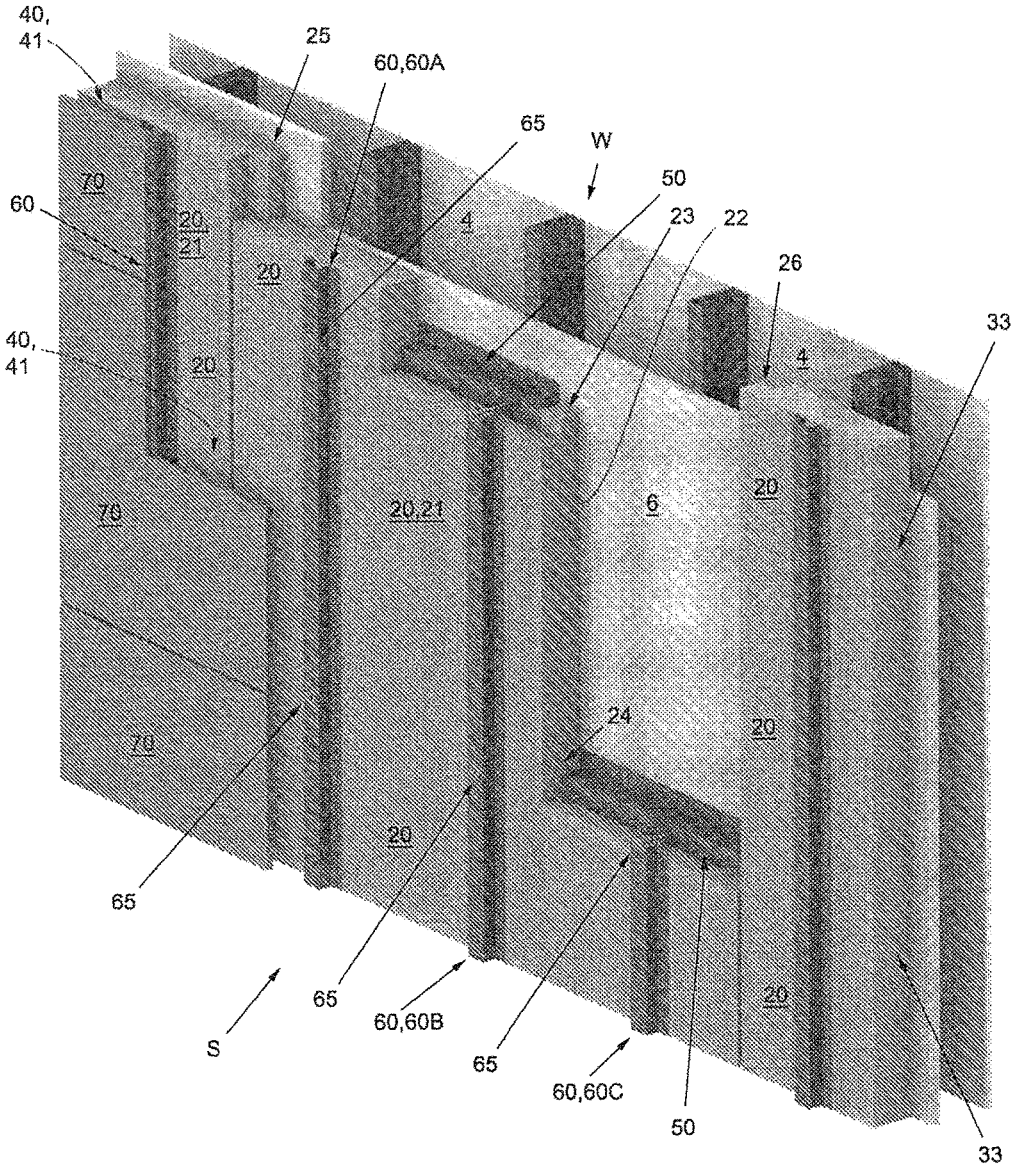
FIG. 2 is another perspective, partial cut-away view of the insulated modular wall system of the embodiment of FIG. 1.
Figure 3:
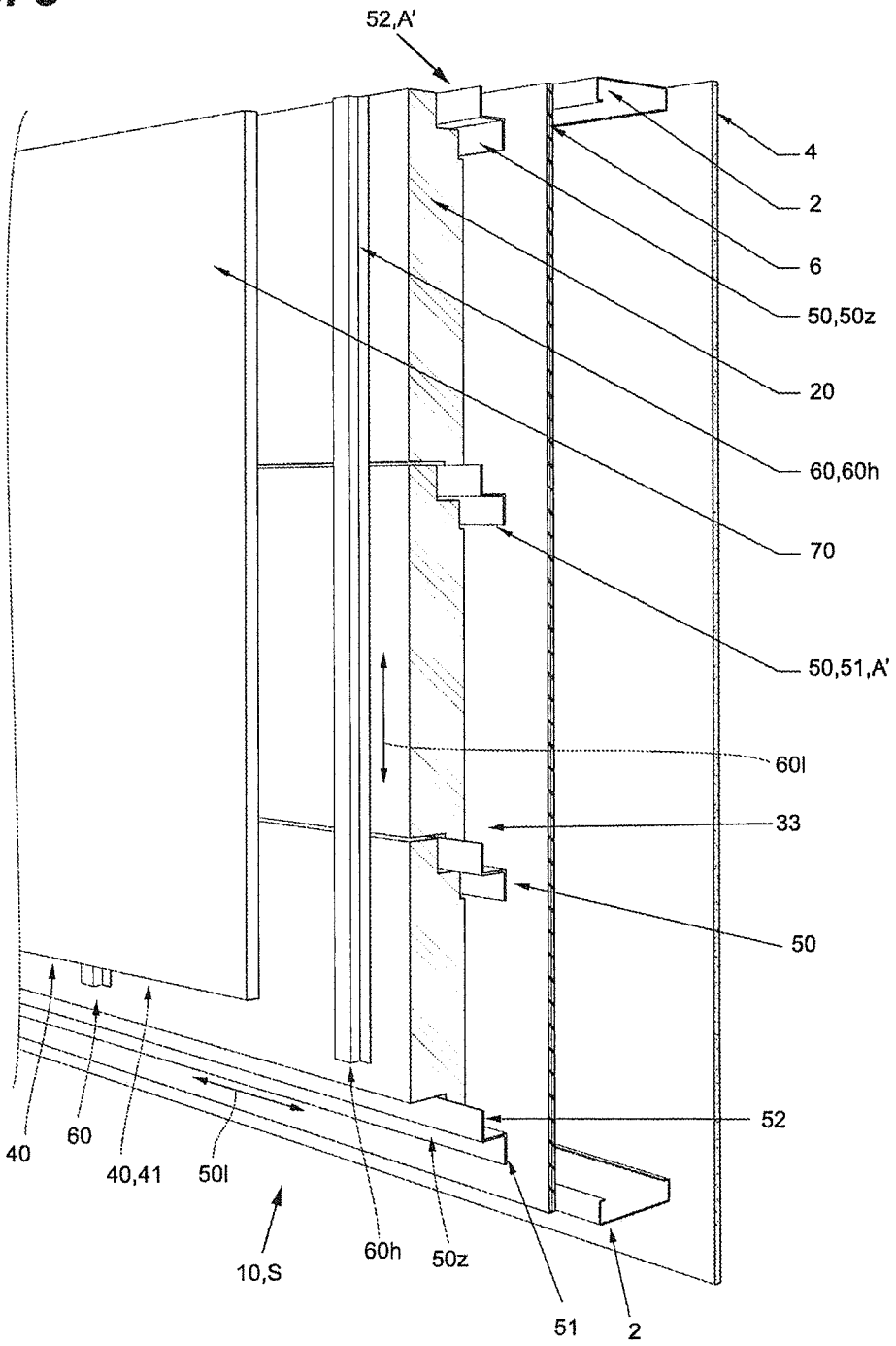
FIG. 3 is yet another perspective, partial cut-away view of the insulated modular wall system of the embodiment of FIG. 1.
Figure 4:
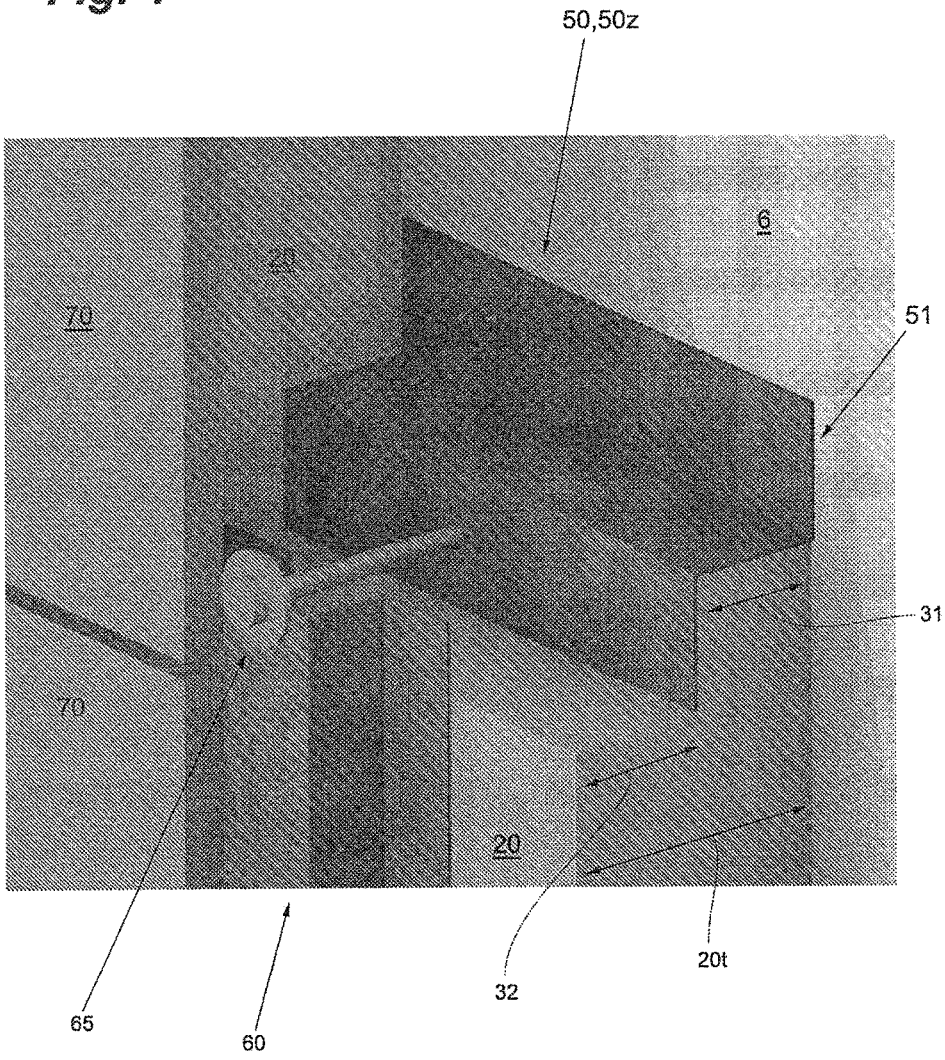
FIG. 4 is a perspective, partial cut-away view of the insulated modular wall system of the embodiment of FIG. 1, showing the first and second support members, fastened in place to secure a modular insulating panel.

Preferably, one or more second elongate support members 60, such as hat tracks or hat channels 60*h* having a longitudinal axis 601, may be mounted against the front surface 21 of the one or more panels 20 (e.g., see members 60A, 60B and 60C in FIG. 2). Second support members 60 may be constructed of metal or plastic. Preferably, a plurality of members 60 are provided in the system 10, each mounted with their longitudinal axis 601 in a substantial vertical orientation, each member 60 substantially parallel to the other and positioned at regular intervals or spacing from any adjacent member 60 (such as 16" or 24" center-on-center spacing). Advantageously, z-girts 50*z* provide anchor points for any fasteners 65 that may be used to mount or place the second elongate support members 60 along the front surface 21 of the panels 20—see FIG. 4. Members 60 further secure the panels 20 to the wall member W and may act to maintain the shiplap joints 33 between adjacent panels 20 (e.g., during wind load or wind pressure).

The length of the fasteners 65 may be set or determined so that said fasteners 65 only penetrate the second end 52 of a z-girt, but do not fully penetrate the first thickness 31 of any underlying rabbet edge 30, or into the sheathing 6. Fasteners 65 used to mount any hat tracks 60*h*, preferably do not penetrate fully through the modular panels 20 and, any thermal bridging that might otherwise occur from the sheathing 6 across fastener(s) 65 may be significantly reduced or eliminated by having the fastener(s) 65 driven through only the second end 52 of the z-girts 50 (rather than direct into the exterior sheathing 6 of the wall member W). More advantageously, hat tracks 60*h* can act in a similar manner as fastening points for any external cladding 70 (such as siding), wherein any fasteners (not shown) used to mount the cladding 70 to the wall member W only penetrate the hat tracks 60*h*, but not fully through the modular insulating panels 20—again, reducing any thermal bridging that might otherwise occur across such fasteners, should they penetrate through the panels 20 into the sheathing 6.

Even more advantageously, the cavity created between adjacent hat tracks 60*h*, the front surface 20 (drainage plane 40), and the cladding 70 may then act as a rainscreen or drainage cavity 41. An insulated modular wall system 10 may be quickly and easily installed, using the z-girts 50 and hat tracks 60*h*, wherein no thermal bridging between the wall member's sheathing 6 and any fasteners 65 is present, and wherein a rainscreen 41 is provided. The plurality of first support members 50 are preferably mounted in a first direction (e.g., substantially horizontal), while the second support members 60 are preferably mounted in a second direction that is substantially perpendicular to the first support members 50 (e.g., substantially vertical). Each support member type 50,60 acting to accept fasteners and prevent thermal bridging to the sheathing 6.

Preferably, an air/vapor barrier 80 may be provided to the system 10 from the roof R of a building, along a z-girt 50*z* and the top-side surface of a panel 20, onto the drainage plane 40 and drainage cavity 41; such as at the interface of the wall member W with a roof parapet P—see FIGS. 5 and 6.

More preferably, the rabbet edge 30 of the bottom-side surface 24 of each panel 20 comprises an additional step or notch 90 to accept the first edge 51 of a z-girt 50 therein, so as to facilitate flush mounting of the panel's back surface 22 against the sheathing 6—see FIG. 1.

Advantageously, this system 10 provides a substantial increase in speed of construction of a thermally broken rain screen system, reduces the amount of construction material (e.g., reduction of any air and vapor barrier film), reduces waste and cutting, all while still maintaining the requirements of typical building codes.

Various embodiments of the present disclosure having been thus described in detail by way of example, it will be apparent to those skilled in the art that variations and modifications may be made without departing from the disclosure. The disclosure includes all such variations and modifications as fall within the scope of the appended claims.

I claim:

1. A modular insulated wall system for attaching to a wall comprising:

a plurality of insulated wall panels, wherein each panel has a stepped-surface including a top-side surface and a substantially parallel bottom-side surface, the top-side surface and bottom-side surface each being complementary stepped and substantially parallel in a first direction, the panels having a front surface and a substantially parallel back surface, wherein the top-side surface and the substantially parallel bottom-side surface each form a step of the stepped surface;

a plurality of substantially parallel z-girts, the z-girts engaged with the stepped surfaces of the plurality of panels;

a plurality of substantially parallel support members in a second direction, the support members affixed to the z-girts with a plurality of fasteners and abutting the front surface of the panels, wherein at least one step of the stepped surface is between and separates the z-girts and the support members.

2. The modular insulated wall system of claim 1, wherein the first direction is substantially horizontal, the second direction is substantially vertical.

3. The modular insulated wall system of claim 2, wherein the stepped top-side surface and bottom-side surface comprise a main step, with the first tread of the step closest to the front surface is higher than the second tread of the step.

4. The modular insulated wall system of claim 2, wherein the plurality of z-girts comprise a first end, a second end offset outward from and parallel to the first end, and a web connecting the first-end and second-end, the first-end for attaching to the wall, and wherein the plurality of support members are affixed to the second end of the z-girts with the fasteners.

5. The modular insulated wall system of claim 1, wherein the support members comprise hat-tracks.

6. The modular insulated wall system of claim 1, further comprising one or more vapor barriers that pass between two of the plurality of panels.

7. The modular insulated wall system of claim 4, wherein the stepped bottom-side surface comprises a notch step, the notch step accommodating the first end of the z-girt.

8. The modular insulated wall system of claim 1, wherein the insulated wall panels further comprise first and second side edges, the first and second side edges are stepped and the first and second side edges of adjoining panels engage.

9. The modular insulated wall system of claim 1, wherein the insulated wall panels further comprise first and second side edges, the first and second edges of adjoining panels abut.

10. A method of installing a modular insulated wall system on a wall comprising:

affixing a first z-girt to the wall, the first z-girt substantially horizontal;

supporting a first insulating panel having a stepped surface using the first z-girt; the first insulating panel having a stepped bottom edge of the stepped surface complementary with the z-girt;

affixing a second z-girt to the wall, the second z-girt capturing a stepped top-edge of the stepped surface of the first insulating panel;

fastening a plurality of support members to the z-girts with fasteners, the support members being substantially perpendicular to the z-girts, wherein at least one step of the stepped surface is between and separates the z-girts and the support members.

11. The method of claim 10, wherein the supporting members are hat tracks.

12. The method of claim 10, further comprising affixing further insulating panels and z-girts, by repeatedly supporting a further panel and a affixing a further z-girt.

13. The method of claim 10, wherein the first and second z-girts, comprising a first end, a second end offset outward from and parallel to the first end, and a web connecting the first-end and second-end, are affixed to the wall using the first edge.

14. The method of claim 10, further comprising attaching cladding to the plurality of support members, wherein a cavity is created between the cladding and the insulating panels.

* * * * *